US006005179A

United States Patent [19]

Currie

[11] Patent Number: 6,005,179

[45] Date of Patent: Dec. 21, 1999

[54] WOODWIND CLEANING SLEEVE

[76] Inventor: Sandra D. Currie, 6905 Lincoln Oaks Dr., Fair Oaks, Calif. 95628

[21] Appl. No.: 09/118,457

[22] Filed: Jul. 17, 1998

[51] Int. Cl.[6] ..... G10G 7/00

[52] U.S. Cl. ..... 84/453; 84/458

[58] Field of Search ..... 84/453, 458, 380 R

[56] References Cited

U.S. PATENT DOCUMENTS 3,739,420 6/1973 Kafkis ..... 15/211
4,114,504 9/1978 Koregelos ..... 84/453
4,967,439 11/1990 LaLonde ..... 15/104.095
5,060,336 10/1991 LaLonde ..... 15/104.1
5,212,332 5/1993 Gigliotti ..... 84/453

*Primary Examiner*—Robert E. Nappi
*Assistant Examiner*—Shih-yung Hsieh

[57] ABSTRACT

The woodwind cleaning sleeve is designed to encase a rigid rod or dowel (20) that assists in pushing the cleaning sleeve through the inside of a musical instrument (22) in order to remove the moisture. The sleeve itself is made of a soft fabric, which protects the inside surface of the instrument as it is being cleaned. The sleeve is designed to be stored outside of the instrument's case (24) to provide for quick drying.

5 Claims, 2 Drawing Sheets

WOODWIND CLEANING SLEEVE

BACKGROUND—FIELD OF INVENTION

This is a product designed to clean moisture out of the inside of a woodwind instrument, with the intention of prolonging the life of the pads on the keys.

BACKGROUND—DESCRIPTION OF PRIOR ART

Traditionally, flutes and piccolos have been swabbed by using a small cloth looped through the notched end of a metal, plastic, or wooden cleaning rod, which is then pushed through the inside of the instrument. There are several problems with this method.

(a) The small cloth may not actually swab the moisture out of the instrument thoroughly enough. On the other hand, if a larger piece of cloth is used, the fabric could easily become lodged inside of the instrument.

(b) There is a high probability that the bore of the instrument will be scratched by the cleaning rod which is partially exposed as the cloth is being pushed through the instrument.

(c) Because the small cloth is not able to pick up the moisture on the first stroke, the process of cleaning an instrument takes longer.

The Demoisturizer for Wind Musical Instrument, U.S. Pat. No. 4,114,504 to Koregelos (1977), was created to reduce the chances of damaging the bore of the instrument, however, there are problems with this cleaning method.

(a) Storing the device is a problem. The cleaning tool is inflexible and large and there is no place to store it in any of the more common woodwind instrument cases. In an attempt to resolve this problem, the instructions on the package of this particular device recommend that the cleaning tool be stored inside of the instrument. However, by doing this, there is another problem created.

(b) When the cleaning tool is left in the instrument, the moisture becomes trapped inside, defeating the purpose of swabbing it, and increasing the likelihood of spreading bacteria.

Other woodwind instruments are most often cleaned using cloth pieces attached to a weight which is dropped through the instrument to assist in pulling the cloth through the bore of the instrument. An example of this method is the Swab For Wind Instruments, U.S. Pat. No. 5,212,332 to Gigliotti (1991). The problems here are similar to the problems occurring in the traditional flute cleaning method.

(a) A small cloth may not effectively clean the inside of the instrument, while a larger cloth could easily become lodged inside.

(b) While dropping a weight down the inside of the instrument, there could likely be scratching to the bore.

OBJECTS AND ADVANTAGES

The woodwind cleaning sleeve was developed to resolve the problems mentioned in the previous paragraphs. Several objects and advantages are:

(a) to increase the fabric surface of a cleaning cloth, making the cleaning of an instrument more effective;

(b) to prevent any risk of getting a cleaning cloth lodged in an instrument;

(c) to make the process of cleaning an instrument more efficient;

(d) to assure against abrasive contact with the bore of the instrument due to unprotected metal, plastic, or wooden rods, dowels, or weights passing through the bore in the process of cleaning;

(e) to encourage a method of storage where the cleaning fabric is quick to dry, so that bacteria will not grow and spread on the fabric, in the case, or in the instrument;

Other objects and advantages include the durability and easy cleaning care of the sleeve. It may be hand or machine washed, and air or machine dried. The cleaning sleeves may be made of fabric in a variety of colors and patterns, adding to the attractiveness of the cleaning device, which is an advantage especially for children who may need encouragement in the proper maintenance of their musical instrument. Additionally, adornments made of soft fabric may be added to the sleeve to create features or characters (for example, a felt tongue added to the top end would create the character of a snake). Further objects and advantages will be discovered with the following description and drawings.

BRIEF DESCRIPTION OF THE DRAWINGS

These descriptions will help to clarify the construction and the usage of the woodwind cleaning sleeve.

REFERENCE NUMERAL IN DRAWINGS

10 bottom of the cleaning sleeve (the open end)
12 top of the cleaning sleeve (the stitched end)
14 folded edge of fabric
16 selvage edge of fabric
18 stitching line
20 rod or dowel (approximately ¼ inch in diameter and 13 inches in length)
22 musical instrument section
24 instrument case handle

SUMMARY

The woodwind cleaning sleeve is designed to encase a rod or a dowel, then to be used in the swabbing out of a woodwind musical instrument.

Description—FIGS. 1 to 4

Figure 1:
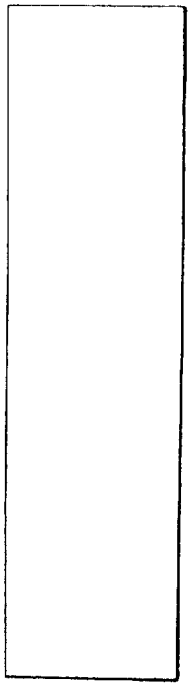
FIG. 1 is a view of the sleeve before assembly.

The cleaning sleeve is designed to encase a rigid rod or dowel. FIG. 1 is a view of the sleeve before assembly. It begins as a rectangle of cloth approximately 40 cm×10 cm. A soft fleecy fabric is recommended, as it not only protects, but is able to fill the inside of the instrument, providing safety and effectiveness.

Figure 2:
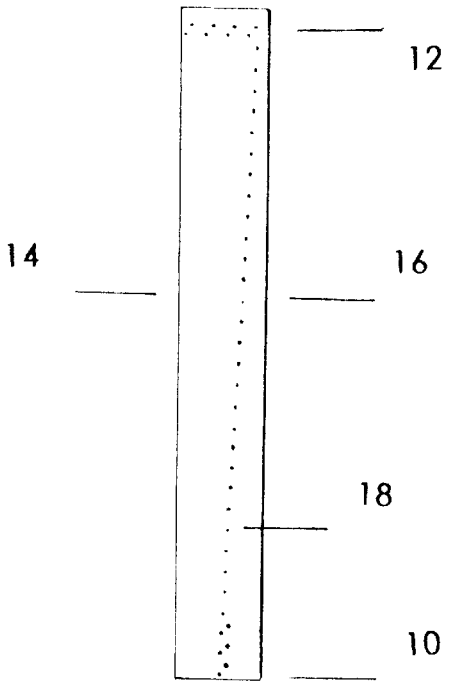
FIG. 2 is a view showing the stitching used to create the sleeve.

The fabric is then folded in half length wise and FIG. 2 indicates the stitching used to create the sleeve design. The stitches are indicated by a dotted line (18). The top (12) is created with a double row of stitching approximately 2 cm from the top edge. The taper in the sleeve is designed to securely encase the rod or dowel and is created with a row of stitches beginning at the top (12) seam at approximately 1 cm inside from the selvage edge (16), and descending in a straight line to the center of the bottom (10). Once again, a double row of stitches is used for reinforcement at the end of that row.

Figure 3A:
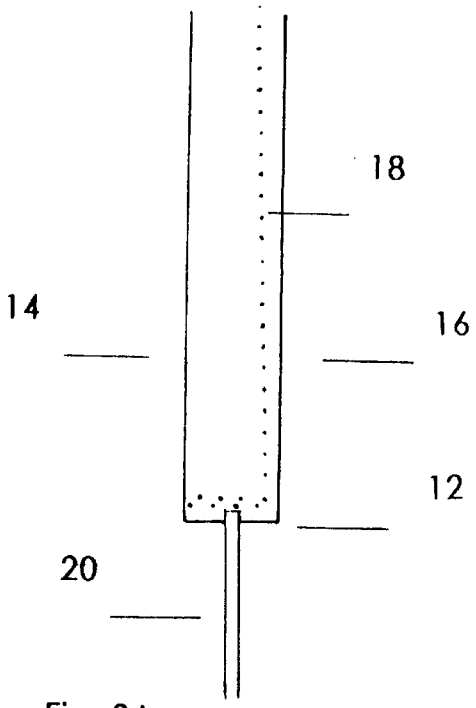
FIGS. 3A and 3B are views describing the process of turning the device right side out.
Figure 3B:
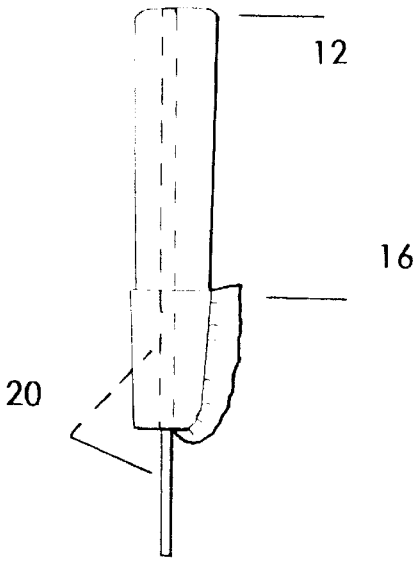
Figure 4:
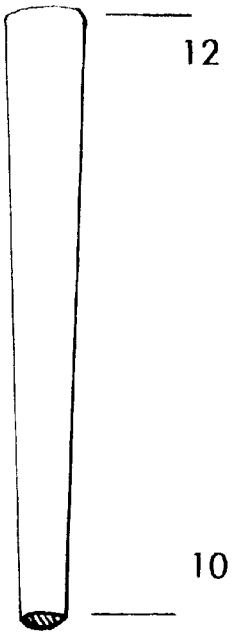
FIG. 4 is a view of the finished Woodwind Cleaning Sleeve.

The process of turning the sleeve to expose the right side is displayed in FIGS. 3A and 3B. The rod or dowel to be used as part of the cleaning process (20) may be used to turn the fabric also. It is placed against the top (12) and the fabric rolls over itself as it is pulled down the rod or dowel to reveal the right side of the cleaning sleeve. The completed cleaning sleeve is shown in FIG. 4.

Figure 5:
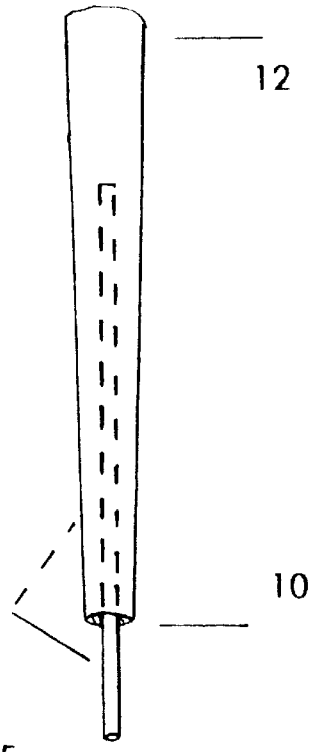
FIG. 5 is a view showing the insertion of the rod or dowel.
Figure 6:
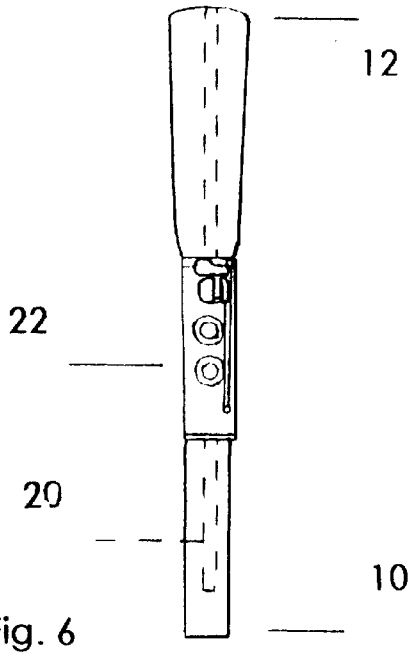
FIG. 6 is a view showing the method of cleaning an instrument.
Figure 7:
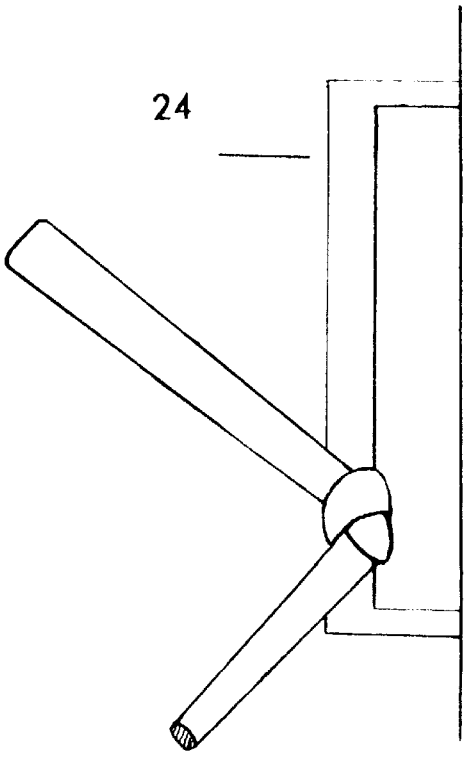
FIG. 7 is a view of a possible storage method of the cleaning sleeve.

Operation—FIGS. 5 to 7

The operation of the cleaning sleeve includes the use of a rigid rod or dowel which assists in guiding the sleeve through the inside of a musical instrument. This is shown in FIGS. 5 to 7. The rod or dowel (20) is inserted into the open end of the cleaning sleeve (10) and pushed to the top. The device is then pushed, top first (12), into the open ended instrument section (22) and then pulled through, as shown in FIG. 6. If the section of the instrument is not open on both ends (for example, a flute head joint), then the device should be pushed in, spun around, and drawn back out in the same direction as it was inserted.

When the moisture has been cleaned out, the sleeve may be removed from the rod or dowel and tied to the instrument case handle (24) for quick drying and sanitary storage. This is demonstrated in FIG. 7. The dowel or rod can easily be stored in the case of the instrument in most instances.

Conclusion, Ramifications, and Scope

As can be seen, the woodwind cleaning sleeve answers many problems that a musician is confronted with concerning the maintenance of his or her instrument. The design and shape of the sleeve allows for a greater surface of fabric and eliminates the chance that the material could get jammed inside of the instrument. The greater surface of fabric also creates a more thorough (as well as faster) method of cleaning. There is protection to the bore of the instrument due to the encasement of the hard surfaces of a rod or dowel used in cleaning. The sleeve's storage options promote a sanitary and effective method of cleaning.

The descriptions in the paragraphs above contain details pertaining to the construction and the usage of the woodwind cleaning sleeve, but the specifications need not limit this invention. The dimensions of the sleeve may vary, according to the woodwind instrument with which this cleaning device is used.

In addition, different types of fabrics may be used, as long as the fabric loosely fills the inside of the instrument and as long as it is very soft, so as not to scratch the bore.

Different colors and patterns can be used to create unique sleeves and simple attachments made of soft fabric may also be added to the cleaning sleeve to create features and characters.

This is a simple, safe, and effective way to clean the moisture from the bore of an instrument. It is also more sanitary than most other methods, as it is easy to clean and care for.

I claim:

1. A cleaning device for removing moisture from the inside of a woodwind instrument, comprising a rectangular fabric sleeve, secured at both long sides and at one end, designed to encase a rigid rod used to assist in pushing said fabric sleeve through said woodwind instrument, wherein said fabric sleeve is at least 2 cm longer than the longest removable section of said woodwind instrument and always longer than said rigid rod or dowel, whereby cleaning moisture from a bore of said woodwind instrument no abrasive surface in contact with said bore.

2. The cleaning device of claim 1 wherein said fabric sleeve is sewn tapered down toward an open end, creating said open end to be approximately two times narrower than said closed end, whereby securely holding said rigid rod inside of said fabric sleeve.

3. The cleaning device of claim 1 wherein the widest part of said fabric sleeve, when gently compressed, is the same diameter as the narrowest part of said bore of woodwind instrument.

4. The cleaning device of claim 1 wherein said fabric sleeve is constructed of a soft, non-shedding fabric with puffiness in texture, such as polar fleece.

5. The cleaning device of claim 1 wherein said rigid rod is at least two times narrower in diameter than the narrowest part of said bore of woodwind instrument and is approximately the same length as said longest removable section of woodwind instrument and always shorter than said fabric sleeve.

* * * * *